US007313921B2

(12) United States Patent
Milke-Rojo et al.

(10) Patent No.: US 7,313,921 B2
(45) Date of Patent: Jan. 1, 2008

(54) APPARATUS AND METHOD FOR THERMO-ELECTRIC COOLING

(75) Inventors: Jorge Guillermo Milke-Rojo, Mexico City (MX); Kuang-Yu Wang, Saratoga, CA (US); David Conrad Neumann, Milwaukee, WI (US); Jeffrey Alan Kautzer, Pewaukee, WI (US)

(73) Assignee: General Electric Company, Schenectady, NY (US)

( * ) Notice: Subject to any disclaimer, the term of this patent is extended or adjusted under 35 U.S.C. 154(b) by 26 days.

(21) Appl. No.: 10/695,318

(22) Filed: Oct. 28, 2003

(65) Prior Publication Data

US 2005/0086948 A1 Apr. 28, 2005

(51) Int. Cl.
*F25B 21/02* (2006.01)
*F25D 23/12* (2006.01)
*G01K 1/00* (2006.01)

(52) U.S. Cl. ..... 62/3.7; 62/3.2; 62/259.2; 702/130

(58) Field of Classification Search ..... 62/3.1, 62/3.2, 3.7, 3.3, 259.2; 702/130; 359/845
See application file for complete search history.

(56) References Cited

U.S. PATENT DOCUMENTS 4,336,444 A * 6/1982 Bice et al. ..... 219/505
4,996,413 A * 2/1991 McDaniel et al. ..... 250/208.1
5,596,200 A * 1/1997 Sharma et al. ..... 250/370.14
5,940,784 A * 8/1999 El-Husayni ..... 702/130
5,980,049 A * 11/1999 Blackmon, Jr. ..... 359/858
6,098,408 A * 8/2000 Levinson et al. ..... 62/3.2
6,201,249 B1 * 3/2001 Yamayoshi ..... 250/370.11
6,370,881 B1 * 4/2002 Maydanich ..... 62/3.2
6,446,442 B1 * 9/2002 Batchelor et al. ..... 62/3.3
2004/0025516 A1 * 2/2004 Van Winkle ..... 62/3.3
2004/0051984 A1 * 3/2004 Oshino et al.

FOREIGN PATENT DOCUMENTS

JP 03041787 A * 2/1991

* cited by examiner

*Primary Examiner*—Chen Wen Jiang
(74) *Attorney, Agent, or Firm*—The Small Patent Law Group LLP; Dean D. Small

(57) ABSTRACT

A temperature regulator provides thermoelectric temperature control in a X-ray detector. The temperature regulator maintains the temperature within the X-ray detector by controlling current through a thermoelectric device. The temperature regulator can both heat and cool the X-ray detector.

24 Claims, 3 Drawing Sheets

APPARATUS AND METHOD FOR THERMO-ELECTRIC COOLING

BACKGROUND OF THE INVENTION

This invention relates generally to medical devices. In particular, this invention relates to X-ray detectors with cooling capabilities.

Imaging electronics found inside X-ray detectors generate thermal energy that must be removed in order to maintain a temperature within an operating range at an X-ray panel. Further, the X-ray panel must be kept on during some procedures that require continuous real-time imaging. The constant operation of the X-ray panel results in an equally continuous requirement for removal of the thermal energy.

Approaches for the removal of thermal energy are further constrained by the environment in which X-ray detectors operate. X-ray detectors are often constrained environmentally and dimensionally. Environmentally, the X-ray detectors are often used in sterile environments, such as an operating room and enclosed in a plastic sterile bag or other sealed enclosure when in operation. The sterile environment also affects the ability to use forced air-cooling in the X-ray detector. Further, the plastic sterile bag or other enclosures often insolates the X-ray detector and results in an increase of thermal energy. Dimensionally, the X-ray detector is part of an X-ray unit that often has to be compact and mobile. Such size requirements require the X-ray detectors to be designed with more constrained airflow and less efficient convection cooling.

In the past, thermal energy transfer in X-ray detectors has been accomplished by a temperature conditioner that circulates liquid coolant through a cold plate attached to the X-ray detector. However, this approach increases the size of the X-ray unit and creates additional issues of corrosion and material incompatibility. Further, the liquids used in cooling systems are often regulated by legal agencies such as the Environmental Protection Agency (EPA), thereby limiting their usefulness in some instances.

Therefore, a need exists for cooling X-ray detectors within a sterile environment and constrained area.

BRIEF DESCRIPTION OF THE INVENTION

Methods and apparatus consistent with the present invention provide temperature regulation for an X-ray detector even when constrained by a sterile environment and within a confined space. The X-ray detector solution is implemented using solid-state devices. As a result, a less expensive temperature regulator allows thermal control over cooling and heating of the X-ray panel within the X-ray detector in order to maintain the temperature within an acceptable thermal range.

In one implementation, two thermally conductive surfaces form an upper and lower surface above and below a number of thermo-electronic devices. The thermo-electronic devices create a thermal gradient when electrical power is applied. When one of the thermally conductive surfaces is connected to an X-ray detector, the other acts as a heat dissipater. Thus, thermal control is achieved by a controller that monitors the temperature in the X-ray detector and adjust the current and voltage polarity in the thermo-electronic devices Other apparatus, methods, features and advantages of the present invention will be or will become apparent to one with skill in the art upon examination of the following figures and detailed description. It is intended that all such additional systems, methods, features and advantages be included within this description, be within the scope of the present invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

Figure 1:
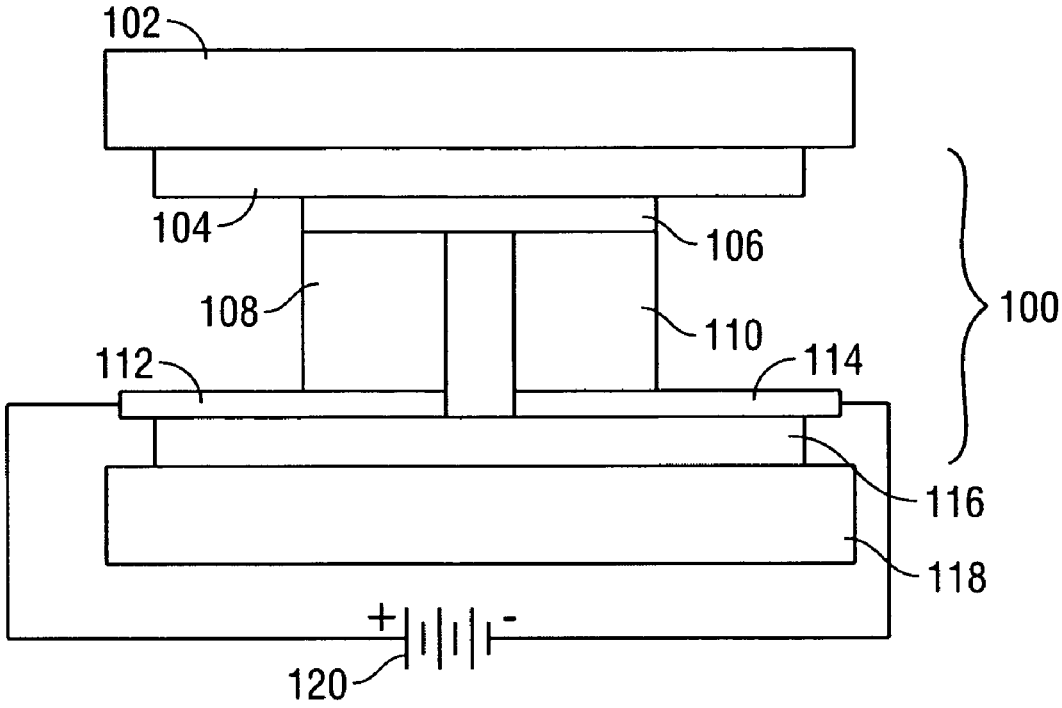
FIG. 1 is a cross sectional view of a thermoelectric temperature device attached to a body to be cooled.

The invention may be better understood with reference to the following figures. The components in the figures are not necessarily to scale, emphasis instead being placed upon illustrating the principals of the invention. Moreover, in the figures, like reference numerals designate corresponding parts throughout the different views.

While the invention has been described in terms of various specific embodiments, those skilled in the art will recognize that the invention can be practiced with modification within the spirit and scope of the claims.

In FIG. 1, a cross sectional view of a thermoelectric temperature device 100 attached to a body 102 that needs cooling is shown. The thermo-electric temperature device 100 includes an electrical insulator 104, a conductive element 106, Bismuth Telluride semiconductor substrate material area doped with a n-type semiconductor material 108 and another area doped with p-type semiconductor material 110. Each of the doped semiconductor material areas 110 and 108 are in contact with an associated electrode 112 and 114. The electrodes 112 and 114 rest on another electrical insulator 116 that is in contact with a heat sink 118. A battery 120 provides current to the thermo-electric temperature device 100.

When current is applied from the battery 120 to the thermoelectric temperature device 100, a path is created from the battery 120 through the electrode 114, the p-type doped semiconductor material 110, the conductive element 106, the n-type doped semiconductor material 108, electrode 112, and back to the battery 120. A hot junction and cold junction are created by the electrical current flowing through the thermoelectric temperature device 100.

The cold junction occurs at the conductive element 106 and cools the body 102. Heat is pumped to the hot junction, the other conductive element 116, from the cold junction at a rate proportional to the current passing through the electrodes 112 and 114. More precisely, the thermal energy at the thermal conductor 106 is absorbed by electrons as they pass from the low energy level in the p-type doped semiconductor material 110, to a higher energy level in the n-type semiconductor material 108. Upon reversing the current's direction through the electrodes 112 and 114, the hot junction and cold junctions reverse. Therefore, the thermo-electric device 100 may operate in one of two modes (cooling or heating) depending on the direction of the supplied current. The thermo-electric device 100 is shown connected to a battery supplying the current. In alternate embodiments, other type of current generating devices may be used such as a generator, alternator, and solar cells.

Figure 2:
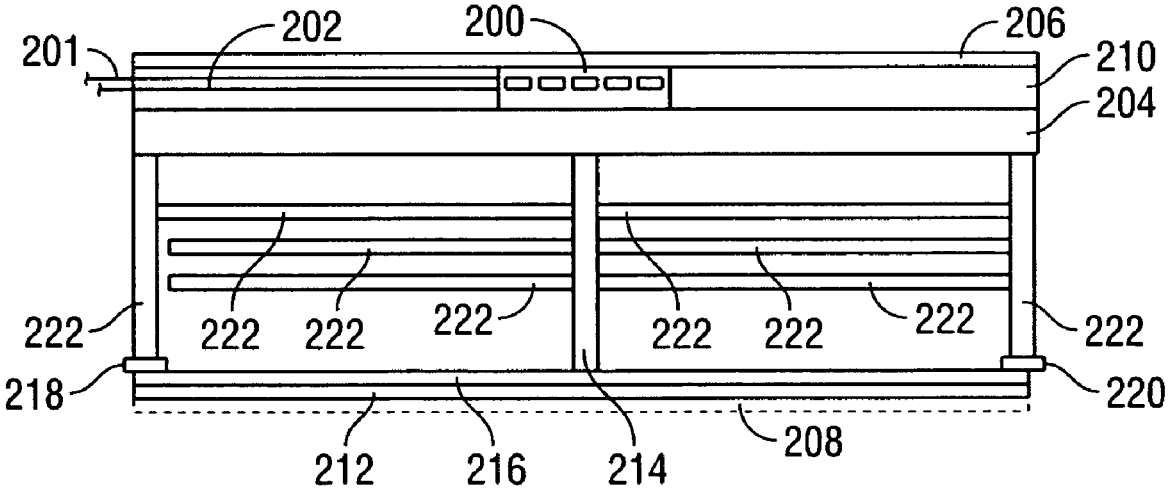
FIG. 2 is a diagram of a thermo-electric temperature regulator incorporating thermoelectric devices of FIG. 1 attached to an X-ray detector.

Turning to FIG. 2, that figure shows a thermo-electric temperature regulator 200 attached to an X-ray panel 208 of an X-ray detector. Current is supplied to the thermo-electric regulator 200 from the positive voltage contact 201 and negative voltage contacts 202. The thermo-electric regulator 200 is in contact with a cold plate 204 and heat sink 206. The cold plate 204 is made from a material that is thermally conductive, such as aluminum. The space between the cold plate 204 and the heat sink 206 is filled with thermal insulation 210 that serves as a thermal barrier between the cold plate 204 and the heat sink 206. A heat dissipating plate 212 may be placed in contact with the X-ray panel 208 in order to conduct thermal energy away from the X-ray panel 208. The heat dissipating plate 212 may be made out of the same material as cold plate 204. In an alternate embodiment, the heat dissipating plate 212 may be made from thermal conducting ceramic.

The heat pipe 214 is in thermal contact with the cold plate 204, while the heat dissipating plate 212 is in thermal contact with the heat pipe 216. The heat pipes 214 and 216 are similarly in contact with each other. Thermal energy generated by the X-ray panel 208 within the X-ray detector is dissipated by the heat dissipating plate 212 and transferred to the cold plate 204 by the heat pipes 214 and 216. The cold plate 204 and heat pipe 216 are thermally isolated from contacting the other electronics 222 by thermal insulation 218 and 220 in order to transfer thermal energy from the X-ray panel 208 through the heat pipes and not through the other electronics 222. The thermal insulation 210, 218, and 220 may be made from an epoxy based insulation material, for example. The heat pipes 214 and 216 may be made out of thermal conducting material identical to the cold plate 204. In other embodiments, the heat pipes may also be made from thermal conducting ceramic material.

The thermo-electric device 100 allows thermal energy to be transferred from the X-ray panel 208 within the X-ray detector without placing possible harmful and corrosive liquids in the X-ray unit. The thermo-electric device 100 also allows a compact X-ray unit to be designed and deployed without increasing risk of infection to patients. Further, the thermo-electric device may be attached directly to the X-ray panel 208 and adjusted to maintain the temperature in the X-ray detector within a predetermined operating range.

A temperature conditioner 3 to 15 meters away from the X-ray detector may be used in conjunction with the thermoelectric device 100 in order to achieve the desired goal of temperature control of the X-ray detector. Examples of a temperature conditioner include a chiller or a heat exchanger. The thermal connection between the X-ray panel 208 in the X-ray detector and the thermoelectrical device may be accomplished with a heat pipe or any other highly conductive material. Further, the X-ray panel may be substantially isolated from the rest of the cooling system allowing additional control of the temperature at the X-ray panel 208 within the X-ray detector.

Figure 3:
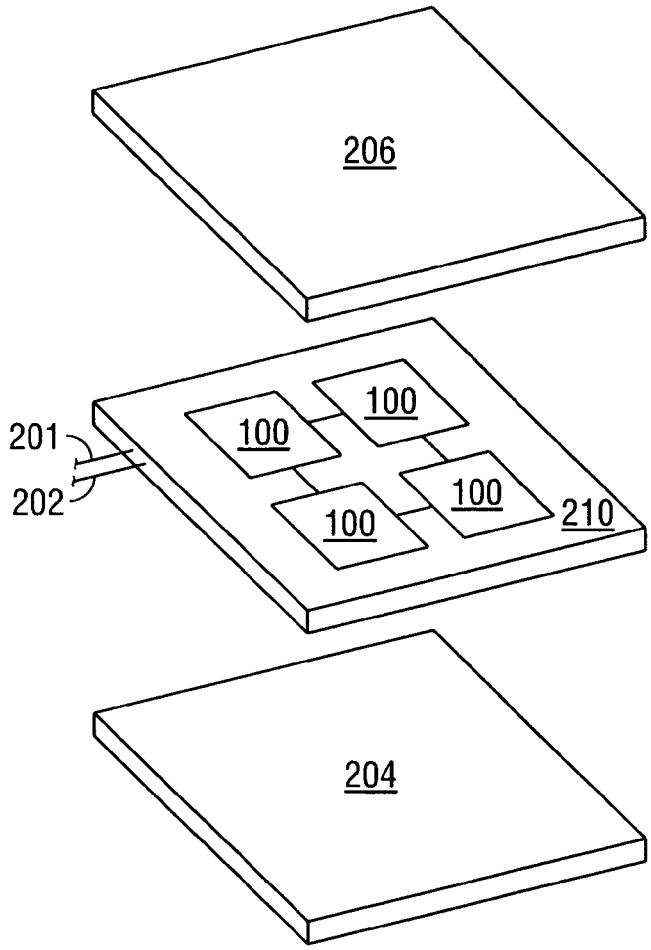
FIG. 3 illustrates a block diagram of the thermoelectric temperature regulator of FIG. 2.

In FIG. 3, a block diagram of the thermo-electric temperature regulator 200 of FIG. 2 is shown. A top plate or heat sink 206 covers the thermo-electric devices 100. The thermo-electric devices 100 are enclosed by an isolation layer or thermal insulation layer 210 that is below the heat sink 206. Although FIG. 3 shows four thermo-electric devices 100 arranged to form the temperature regulator 200, it is noted that additional or fewer thermo-electric devices 100 may be used in any particular regulator design, according to pre-defined heating or cooling needs. The thermal insulation layer 210 thermally isolates the heat sink 206 from the cold plate 204. Some examples of material that may be used in the isolation layer include ceramics and silicon material. The positive voltage contact 201 and negative voltage contacts 202 provide paths for current to flow to the thermoelectric devices 100. The isolation layer 210 along with thermo-electric devices 100 are contact with both the heat sink 206 and the cold plate 204.

Figure 4:
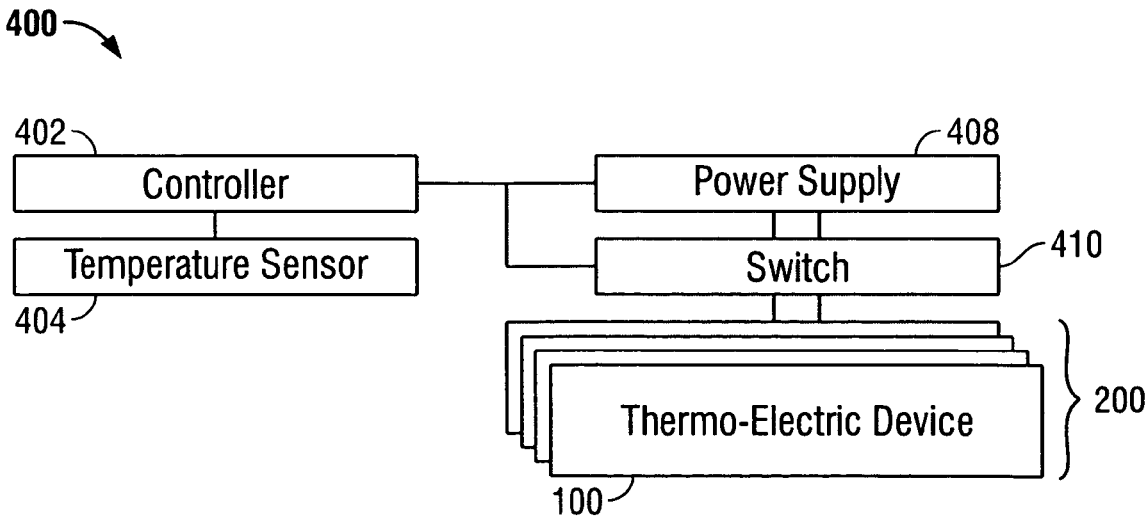
FIG. 4 is a block diagram of a circuit with the thermo-electric temperature regulator of FIG. 2.

Turning to FIG. 4, a block diagram 400 of support circuitry for the thermo-electric temperature regulator 200 of FIG. 2 is shown. A controller 402 is connected to a temperature sensor 404, a temperature regulator 200 and a power supply 408. The power supply 408 is connected to the controller 402 and temperature regulator 200. The controller 402 may be a microprocessor or microcontroller programmed to adjust the current supplied by the power supply 408 to the temperature regulator 200. In other embodiments, the controller 402 may be an application specific integrated circuit (ASIC), discrete logic functioning as a controller, analog devices functioning as a controller, or a combination of the above configured to function as a controller.

The controller 402 may reverse the voltage generated by the power supply 408 and received by the thermoelectric device 406. In one embodiment, the controller 402 activates a switch 410, such as a relay, to reverse the voltage. In an alternate embodiment, a solid-state device may be used to switch the voltage and switch the thermo-electric device from a cooling mode to a heating mode. The controller 402 may be located within the X-ray detector or may be located external to the X-ray detector.

Figure 5:
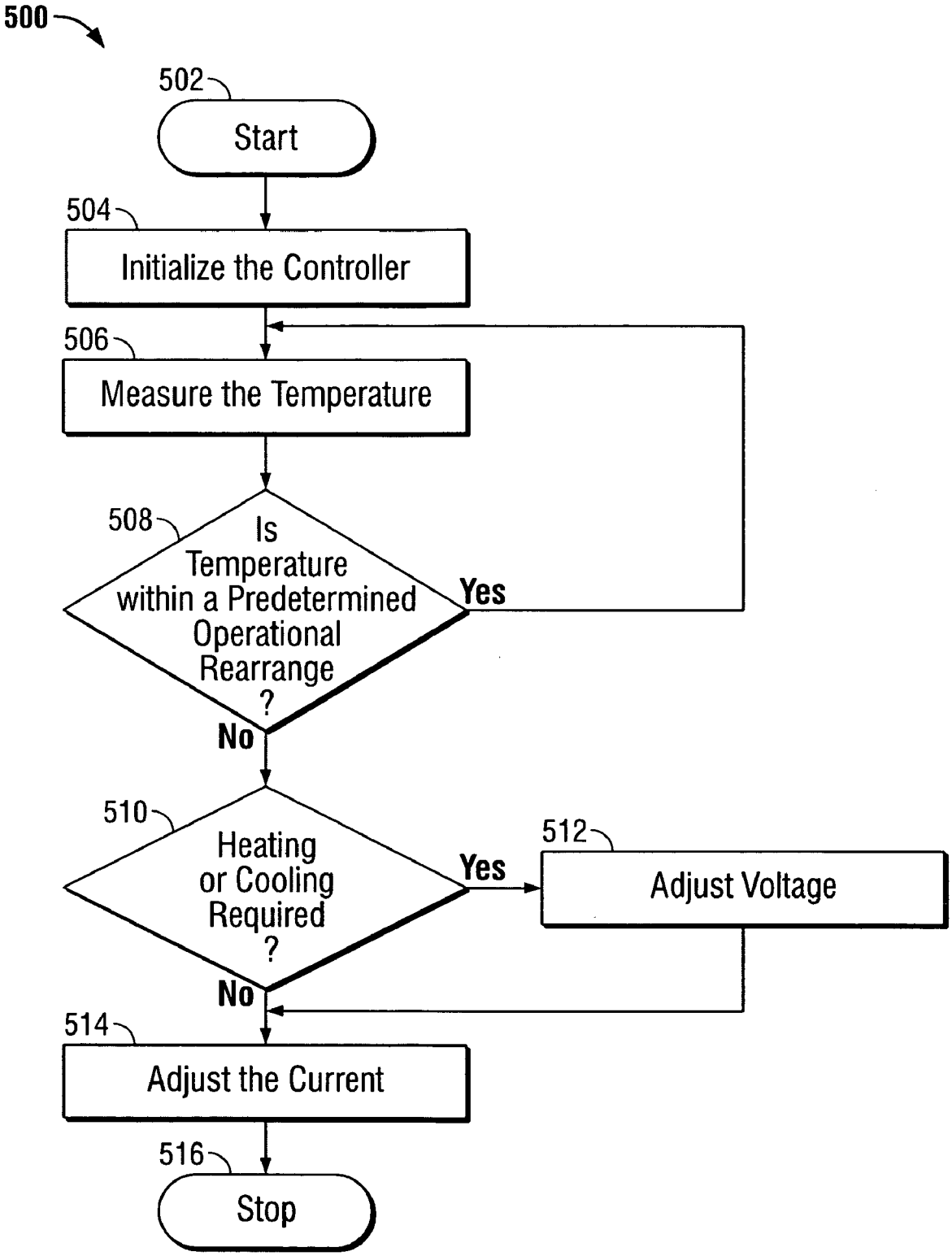
FIG. 5 is a flowchart of the process that maintains the temperature of the X-ray detector of FIG. 2.

In FIG. 5, a flowchart 500 shows the process that maintains the temperature of the X-ray detector in FIG. 2. The process starts (Step 502) with the controller 402 being initialized upon power being applied to the X-ray detector (Step 504). The temperature sensor 404 measures the temperature within the X-ray detector (Step 506). The measured temperature is reported to the controller 402 where the controller 402 determines if the temperature of the X-ray detector is within a predetermined operating range (Step 508). If the temperature is within the operating range, then the temperature of the X-ray detector is again measured by the temperature senor 404 (Step 506). If the temperature is not within a predetermined operating range, then the controller 402 determines whether heating or cooling is desired (Step 510).

If heating is desired, then the voltage is adjusted by reversing the voltage received at the positive and negative inputs of the thermoelectric device 406 (Step 512). The default configuration is with the voltage polarity configured so the thermoelectric device 406 cools the X-ray detector. The amount of cooling is controlled by adjusting the current through the thermoelectric device 406 (Step 514). More current yields increased cooling. If cooling is desired and the voltage is in the default configuration, then the current is adjusted to either decrease or increase cooling (514). If cooling is required and the voltage is configured for heating, then the voltage is reversed. In an alternate embodiment, a fix current is supplied to the thermo-electric device 406.

The process is shown as stopping in FIG. 5 (Step 516). In practice, the process is continuously repeated by returning to step 506. In another embodiment, the process is repeated a predetermined intervals, such as every 30 seconds. In other embodiments, the process may be repeated upon a temperature threshold being detected.

The foregoing description of an implementation of the invention has been presented for purposes of illustration and description. It is not exhaustive and does not limit the invention to the precise form disclosed. Modifications and variations are possible in light of the above teachings or may be acquired from practicing of the invention. For example, the described implementation includes software but the present invention may be implemented as a combination of hardware and software or in hardware alone. Note also that the implementation may vary between systems. The invention may be implemented with both object-oriented and non-object-oriented programming systems. The claims and their equivalents define the scope of the invention.

What is claimed is:

1. A temperature regulator that adjusts a temperature of an X-ray detector, comprising:

a controller;

a thermal sensor reporting temperature data to the controller;

a thermo-electric device having a positive voltage contact and a negative voltage contact that responds to the controller being in receipt of the temperature data from the thermal sensor, the contacts configured to allow reversing a voltage applied thereto;

a heat dissipating plate in contact with an X-ray panel of the X-ray detector;

a cold plate in thermal contact with the heat dissipating plate via a heat pipe, at least one of the heat dissipating plate and cold plate connected to the thermo-electric device; and thermal insulation configured to thermally isolate the cold plate from electronics of the X-ray detector.

2. The apparatus of claim 1, further comprising:

a switch that switches the positive voltage contact and the negative voltage contact.

3. The apparatus of claim 1, wherein the thermal sensor is a thermocouple.

4. The apparatus of claim 1, wherein the thermal sensor is in contact with an X-ray panel.

5. The apparatus of claim 1, further comprising:

a voltage source connected to the positive voltage contact and the negative voltage contract.

6. The apparatus of claim 1, wherein the thermo-electric device is a solid state thermo-electric device.

7. The apparatus of claim 1, further comprising: a switch that controls current direction at the positive voltage contact controlled by the controller in response to receipt of temperature data.

8. The apparatus of claim 1, where the thermo-electric device responds to the control to maintain an X-ray panel in the X-ray detector within a predetermined temperature range.

9. The apparatus of claim 8, wherein the predetermined temperature range is twenty-five to thirty-five degrees Celsius.

10. A method for regulating temperature of a medical X-ray detector, the method comprising the steps of:

measuring a temperature of the medical X-ray detector;

determining if the temperature of the medical X-ray detector is within a predetermined operational range;

adjusting via a positive voltage contact and a negative voltage contact a current that enters a thermo-electric device in order to change the temperature of the medical X-ray detector;

providing a heat dissipating plate in contact with an X-ray panel of the medical X-ray detector and in thermal contact with a cold plate via a heat pipe with heat being transferred from the heat dissipating plate to the cold plate via the heat pipe; and thermally isolating at least one of the beat pipe and cold plate from electronics of the X-ray detector.

11. The method of claim 10, further comprising the steps of:

identifying a mode of temperature control the device requires; and changing polarity of a voltage entering the thermo-electric device in response to the mode of temperature control.

12. The method of claim 11, wherein the step of changing further comprises the step of:

switching the voltage with an electromagnetic switch that responds to the controller.

13. The method of claim 10, where measuring further comprise:

sending data from a thermocouple to the controller.

14. The method of claim 10, wherein the thermo-electric device is a solid-state thermo-electric device.

15. The method of claim 10, wherein the predetermined operating range is twenty-five to thirty-five degrees Celsius.

16. A system that adjusts a temperature in a X-ray detector, the system comprising:

a controller;

a thermal sensor reporting temperature data to the controller;

a thermo-electric device having a positive voltage contact and a negative voltage contact that responds to the controller being in receipt of the temperature data from the thermal sensor, the contacts configured to allow reversing a voltage applied thereto;

an external cooling device that removes thermal energy from the thermo-electric device; and a cold plate and a heat sink connected to the thermo-electric device, the heat sink in contact with an X-ray panel of the X-ray detector;

at least one heat pipe thermally connecting the cold plate and the heat sink; and thermal insulation between electronics of the X-ray detector and at least one of the heat pipe and cold plate.

17. The apparatus of claim 16, further comprising:

a switch that switches the positive voltage contact and the negative voltage contact.

18. The apparatus of claim 16, wherein the thermal sensor is a thermocouple.

19. The apparatus of claim 16, wherein the thermal sensor is a solid-state thermal sensor.

20. The apparatus of claim 16, wherein the thermal sensor is in contact with an X-ray panel.

21. The apparatus of claim 16, further comprising:

a voltage source connected to the positive voltage contact and the negative voltage contract.

22. The apparatus of claim 16, wherein the thermo-electric device is a solid-state thermo-electric device.

23. The apparatus of claim 16, wherein the external cooling device is a liquid cooling device.

24. The apparatus of claim 16, where the external cooling device is located more than three meters from the thermo-electrical device.

* * * * *